United States Patent [19]

Pitard

[11] 4,304,377

[45] Dec. 8, 1981

[54] ELECTRICAL BLOCK SEPARATING JOINTS FOR RAILWAY SIGNALING SYSTEMS

[75] Inventor: Pierre Pitard, Viroflay, France

[73] Assignee: Compagnie de Signaux et d'Entreprises Electriques, Paris, France

[21] Appl. No.: 912,765

[22] Filed: Jun. 5, 1978

[30] Foreign Application Priority Data

Jun. 8, 1977 [FR] France ..... 77 17490
Jun. 22, 1977 [FR] France ..... 77 19075

[51] Int. Cl.[3] ..... B61L 21/06
[52] U.S. Cl. ..... 246/34 CT; 246/187 B
[58] Field of Search ..... 246/34 CT, 34 R, 40, 246/51, 58, 77, 122 R, 128, 129, 130, 182 B, 48, 52, 57, 75, 187 B

[56] References Cited

U.S. PATENT DOCUMENTS

| | | | |
|---|---|---|---|
| Re. 27,472 | 9/1972 | Thorne-Booth | 246/34 CT |
| 3,746,857 | 7/1973 | Hoyler et al. | 246/36 |
| 3,794,833 | 2/1974 | Blazek et al. | 246/34 CT X |
| 3,868,075 | 2/1975 | Blazek | 246/34 CT |
| 3,949,959 | 4/1976 | Rhoton | 246/34 CT |

FOREIGN PATENT DOCUMENTS

| | | | |
|---|---|---|---|
| 1128885 | 5/1962 | Fed. Rep. of Germany | 246/34 CT |
| 1190492 | 4/1965 | Fed. Rep. of Germany | 246/34 CT |
| 1530437 | 5/1970 | Fed. Rep. of Germany . | |
| 1941917 | 3/1971 | Fed. Rep. of Germany | 246/34 CT |
| 2053897 | 5/1972 | Fed. Rep. of Germany . | |
| 1424745 | 4/1968 | France . | |
| 1020037 | 2/1966 | United Kingdom | 246/34 CT |
| 1326885 | 8/1973 | United Kingdom | 246/34 CT |

*Primary Examiner*—J. D. Miller
*Assistant Examiner*—Reinhard J. Eisenzopf
*Attorney, Agent, or Firm*—Charles E. Brown

[57] ABSTRACT

An electrical joint for separating adjacent block circuits of a railway signaling system in which the rails of the railway track serve as conductors. The upstream circuit block carries first frequency signals and the downstream block circuit carries second frequency signals. The electrical block separating joints are bounded by tuning units of which one may be a mere impedance and which are responsive to the frequencies of the circuit blocks and constitute respectively a low impedance for the first or second frequency and a capacitive impedance for the other of the first or second frequency. There are transmitter and receiver units the latter of which is associated to activate a control device, e.g. a relay, for the associated block circuit to de-activate the control device when a vehicle enters the electrical joint by a shunting effect. An overlapping shunting effect is produced in the electrical joint by one, two or three inductive loops wherein coupled to the receiver and transmitter units which prevent a vehicle axle remaining in the electrical joint undetected.

20 Claims, 10 Drawing Figures

ELECTRICAL BLOCK SEPARATING JOINTS FOR RAILWAY SIGNALING SYSTEMS

The present invention relates to improvements in electrical joints separating adjacent block circuits for use in railway block signaling equipment.

More generally, the invention relates to railway signaling systems utilizing the rails of the track as conductors, the track comprising continuous rails without mechanical insulating joints and a plurality of successive block circuits separated by electrical separating joints.

Each of the block circuits comprises an entity with which are associated transmitter and receiver units operative at a particular block frequency and adapted to activate or energize a control device or signal box of the signaling system. The flow of electrical signals, or more precisely their amplitude, is a function of the presence or absence of vehicles in the particular block circuit the axles of which having a shunting effect in the block circuits they pass through. The electrical joints separating two adjacent block circuits thus comprise transition zones; a representative axle entering these transition zones successively produces, with variable gradualness, the elimination of the shunting effect upstream relative to the direction of the vehicles movement and the application of the shunting effect downstream thereof.

In prior art block signaling systems transmitter or receiver oscillating circuits were, together with tuning units and other devices, connected directly to the rails of the block circuits at the block separating joints. With such an arrangement, only considering the switching of the signaling devices, it is obvious that in most critical conditions, the switching of the upstream control device relative to the direction of traffic flow may only slightly precede the switching of the downstream control device. Accordingly, if a railway vehicle is immobile in the transition zone of electrical joint a switching of the upstream control device, manifesting that the vehicle has cleared the joint, may occur prematurely.

Moreover, the galvanic coupling of the switching equipment with the track causes numerous constraints and also imposes certain limitations.

To overcome these problems, an object of the invention is to provide an electrical joint for separating two adjacent block circuits characterized by the following novel features:

(a) the provision, even in the most critical conditions, of an overlapping shunting effect zone in the electrical joint with the possibility of controlling its characteristics; and (b) the galvanic separation of the signaling equipment from the track.

According to the invention there is provided an electrical joint for separating two adjacent block circuits respectively upstream and downstream relative to the direction of traffic flow, of a railway block circuit signaling system in which the rails serve as electrical conductors, said upstream block circuit carrying electric signals of a first frequency and said downstream block circuit electric signals of a second frequency, the electrical joint being bounded at its respective ends by upstream impedance means responsive to the first frequency and constituting a low value at the second frequency and a capacitive value at the first frequency, and a downstream impedance means responsive to the second frequency and constituting a low value at the first frequency and a capacitive value at the second frequency, said impedance means both being associated with receiver and transmitter units respectively, said receiver unit being normally adapted to activate a control device for its associated block circuit and de-activate the control device in response to the shunting effect caused by a vehicle axle present in the electrical joint, characterized by at least one inductive loop coupled to one said receiver or transmitter unit and constructed and arranged so that upon the passage of a vehicle axle the gradual return of the amplitude of the first frequency signal to the amplitude of activation of the control device in the upstream circuit block occurs after the gradual attenuation of the second frequency signals in the downstream block circuit causing the de-activation of the control device so as to provide an overlapping shunting effect zone.

Preferably the inductive loop or circuit is coupled to the rails of the track circuit.

The provision of the inductive loop(s) or circuit(s) in the electrical joint offers the following advantages:

(1) the separation permits the coupling of the receiver unit for switching the control device at any location in the separating joint and, therefore, the controlling of the switching sequence of the upstream and downstream control devices and thus the controlling of the characteristics of the overlapping shunting effect zone; and (2) the sought-after galvanic separation between the track and the signaling equipment.

It is apparent that the configuration and size of the inductive loop(s) permits the controlled variation of the characteristics of the overlapping shunting effect zone.

According to a preferred embodiment the separating joint comprises first and second inductive loops disposed at the respective upstream and downstream ends of the separating joint. Such an embodiment affords numerous possibilities.

Thus, for instance, at least one of the inductive loops may be connected to the receiver or transmitter unit responsive to the frequency of the block circuit with which it is associated.

In the double loop embodiment the first or upstream loop is connected to the receiver or transmitter unit for the first frequency and the second or downstream loop is connected to the other of the receiver or transmitter unit for the second frequency.

In any event the selection of the location of the inductive loops coupled to the receiver and transmitter units of the upstream and downstream block circuit permits the monitoring of the overlapping shunting effect zone.

In order to achieve a maximum overlapping shunting effect zone the receiver unit is coupled to the upstream inductive loop and the transmitter unit is coupled to the downstream inductive loop. Such an embodiment is highly advantageous.

In any of the preceding embodiments, in order to form an independent block circuit, it is also possible to couple the inductive loop to a receiver unit responsive to a single frequency, the block circuit being bounded by a single tuning unit adjacent the loop and providing a low impendance at the single frequency, and by an impedance, instead of a second tuning unit, connected in parallel across the rails and coupled to the transmitter for the single frequency.

Such an independent block circuit may be constituted by using two inductive loops in which case they are coupled to the receiver or transmitter unit responsive to the single frequency, the block circuit being bounded at each of its ends by a tuning unit each of which offers a low impedance at the single frequency.

In such an embodiment the separating joint according to the invention provides on any section of track and independently of the pre-existing signaling system, a block circuit responsive to electric signals at a single predetermined frequency.

Needless to say the length of the block circuit thus constructed may be selected as a function of a specific application, and may, in particular, permit picking up localized information by the control device at greater or lesser intervals.

Numerous other alternatives may also be derived from the basic arrangement without departing from the spirit of the present invention.

According to one such further alternative, the separating joint comprises a third inductive loop disposed at a predetermined point between the first and second inductive loops subdividing the block circuit into upstream and downstream sub-blocks, coupled to the transmitter unit responsive to the single frequency, and the first and second loops are respectively coupled to receiver units responsive to the single frequency and adapted to activate a control device. This arrangement affords the possibility of providing smaller intervals and information which is generally more detailed.

Another use of the invention permits overlaying electrical separating joints on a block circuit responsive to different electric signals. In this case a block circuit is responsive to predetermined electric signals and may be considered as a carrier circuit of an independent block circuit responsive to different electric signals transported by the carrier circuit.

In all these embodiments the receiver unit provided in the block separating joint is adapted to activate a control device which may be operatively coupled to other devices of a railway signaling system.

Similarly it is to be noted that one of the inductive loops may also be coupled to such signaling equipment. In that lies another advantage of the block separating joint according to the invention which permits isolated or combination and/or feedback coupling with other devices of the signaling system.

Other features and advantages of the invention will become apparent from the following description, given merely by way of example, with reference to the accompanying schematic drawings, in which.

The description which follows is confined to the operational features of devices and components peculiar to the present invention and to the switching or change of state of the associated control devices, without the details of railways signaling systems which are well known to those skilled in the art.

Figure 1:
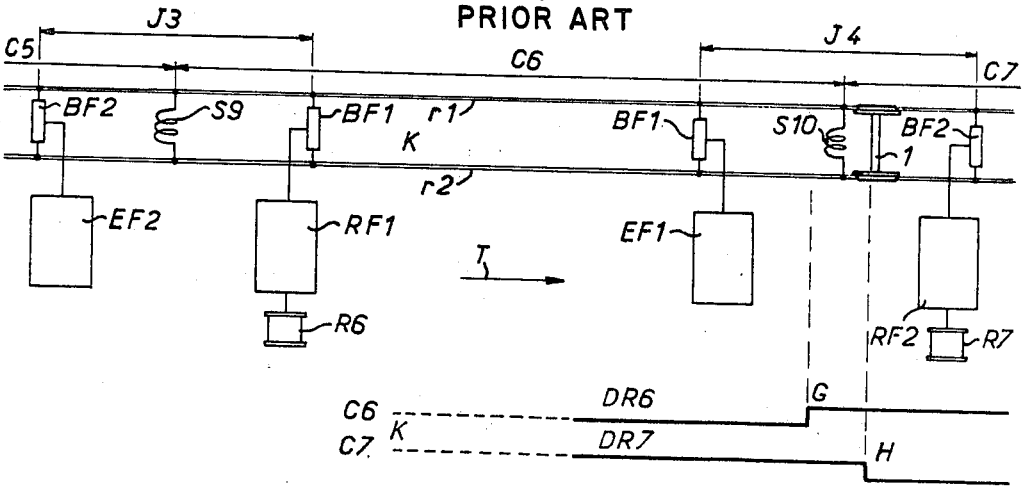
FIG. 1 PRIOR ART
FIG. 1 is a schematic showing of a track circuit including a block circuit separated at its ends from upstream and downstream block circuit by electrical block separating joints according to the prior art.

Reference will first be had to FIG. 1 to review the state of the art with regard to electrical block separating joints. Along the rails r1 and r2 of a railway track are represented two block separating joints designated overall by references J3 and J4 and defining a track section of block circuit C6 included between adjacent block circuits C5 and C7 respectively disposed upstream and downstream thereof relative to the direction T of traffic flow. Frequencies F1 and F2 are induced respectively into block circuits C5 and C7. The block separating joints are bounded by tuning units BF2 and BF1. In a manner known per se inductive coils S9 and S10 with air cores are wired in parallel with the tuning units BF1 and BF2 across rails r1 and r2 midway along each of the separating joints J3 and J4. The tuning units BF1 are formed as short-circuit connections for frequency F2 and as capacitive impedances at frequency F1. Conversely, the tuning units BF2 serve as short-circuit connections for the frequency F1 and capacitive impedances at frequency F2.

The equipment of the block circuit C6 is completed with a transmitter unit EF1 supplying signals of frequency F1 and a receiver unit RF1 sensing the same frequency. These two units EF1 and RF1 are respectively coupled to the tuning units BF1 bounding block circuit C6 via an impedance matching transformer (not shown).

The receiver unit RF1 is connected to a control device R6 such as a relay of the signaling system.

Similarly, the adjacent block circuits C5 and C7 are equipped with transmitter and receiver units EF2 and RF2 coupled to tuning units BF2 via impedance matching transformers (not shown).

In the absence of any shunting effect along block circuits C5, C6 and C7 signals are carried at their frequencies and picked up by corresponding tuned receiver units activating associated relays or control devices R6 and R7.

Diagrams DR6 and DR7 illustrate the switching or changes of state of relays R6 and R7 when an axle of a vehicle coming from block separating joint J3 eventually enters block separating joint j4.

When the axle is at position K (upstream of separating joint J4 in the drawing) the block circuit C6 is shunted, the frequency F1 signals picked up by the receiver unit RF1 have an amplitude incapable of activating relay R6 which thus remains in its rest condition. On the other hand, relay R7 is supplied normally and is activated.

Upon axle 1 clearing tuning unit BF1 located at the upstream end of the separating joint J4 the shunting effect of block circuit C6 diminishes gradually so that at G the amplitude of frequency F1 signals reach a value sufficient to insure the energization of relay R6 which remains in activated condition until the next axle passes. Concurrently, as the axle proceeds along the separating joint J4, the shunting effect is imparted to block circuit C7 and at H the shunting effect sufficiently reduces the amplitude of the F2 frequency signals to trigger relay R7 which remains in this condition until the axle clears the following separating joint.

It is noted that between point G and H, under the most critical conditions, relays R6 and R7 would both be energized; there would therefore not be any overlapping shunting effect zone in case a hypothetical single axle clears the separating joint. If an axle gets stuck between points G and H a premature energization of upstream relay R6 would ensue.

It will be pointed out that points G and H do not correspond to any particular geometrically determined points along the separating joint but vary within predetermined limits. This is equally applicable to the remainder of the description.

Figure 2:
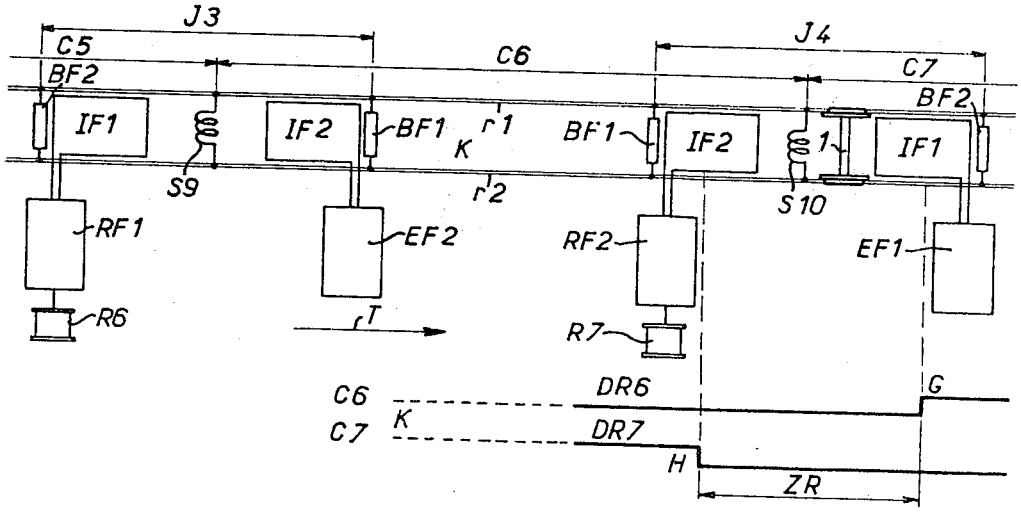
FIG. 2 is a schematic showing of a track circuit as in FIG. 1 in which the block separating joints are constructed according to a first embodiment of the invention.

Reference will now be made to FIG. 2 corresponding to the same block circuits C5, C6 and C7 in which the separating joints J3 and J4 are embodied according to the invention. Further, like parts will be designated by the same reference characters as above.

Each of the separating joints J3 and J4 comprises two inductive loops IF1 and IF2 located proximate to tuning units BF1 and BF2. The inductive loops IF1 and IF2 are connected to receiver units RF1 and RF2 and transmitter units EF1 and EF2. In contradistinction to the prior art arrangement of FIG. 1, receiver unit RF1 is no longer associated with the upstream tuning unit BF1 but instead with the inductive loop IF1 located proximate to the upstream tuning unit BF2 and that the transmitter unit EF2 is no longer associated with upstream tuning unit BF2 but instead with the inductive loop IF2 located proximate to the downstream tuning unit BF1. The same arrangement is repeated in the electrical separating joint J4. The control devices or relays R6 and R7 are again associated with the corresponding frequency receiver unit but are located upstream of their electrical separating joint relative to direction of traffic flow.

It will be recognized that each induction loop is actually coupled to the corresponding transmitter or receiver unit through an intermediate circuit, which has been omitted from the drawing for the sake of clarity, and which serves to provide a high impedance for suppressing undesired frequencies in the inductive loop and to regulate the inductive loop to the desired frequency.

This arrangement of components in the electrical block separating joint results in operating diagrams DR6 and DR7 for relays R6 and R7 of block circuits C6 and C7.

When the axle 1 is at K the state of the relays is identical with the relays in the prior art arrangement of FIG. 1. But once the axle enters the separating joint J4 and owing to the position of the induction loop IF1 with which the transmitter unit EF1 is associated, point G is markedly displaced downstream (to the left in FIG. 2) whereas for the same reasons point H is markedly displaced upstream (to the left in FIG. 2). Between points G and H there is consequently an overlapping shunting effect zone ZR in which relays R6 and R7 are both de-activated.

It is readily apparent that the shunting effect results, upon the passage of the axle along the inductive loops, in a gradual variation in the amplitude of signals flowing along the block circuits concerned.

Figure 3:
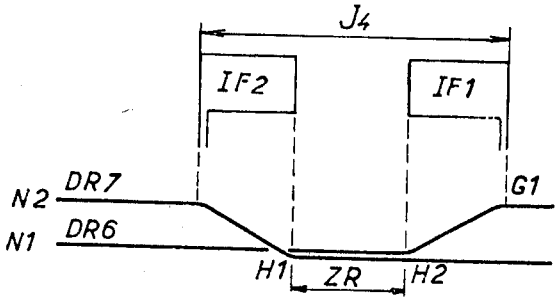
FIG. 3 is a fragmentary view of one of the block separating joints of FIG. 2 illustrating the variations of amplitude of the signals in the block circuit associated with the block separating joint.

FIG. 3 represents the inductive loops IF1 and IF2 of a separating joint (e.g. J4) in which N1 and N2 are amplitudes causing a change of state or switching. Even keeping with the gradual nature of the amplitude variations displacing points G and H of activation and de-activation, there is nevertheless an overlapping shunting effect zone ZR between points H1 and H2 which is ensured by the presence of the inductive loops. Moreover, there are certain parameters available to affect the characteristics of the overlapping shunting effect zone, such as, the position of the inductive loops in the separating joint, the length of the sides of the loops parallel to the rails, the geometrical shape of the loops, and the number of turns or windings. It is understood that the novel arrangement permits the section of the desired length of the overlapping shunting effect zone and the topographical computation with the accuracy formerly possible only with mechanical insulating joints between adjacent circuit blocks.

Figure 4:
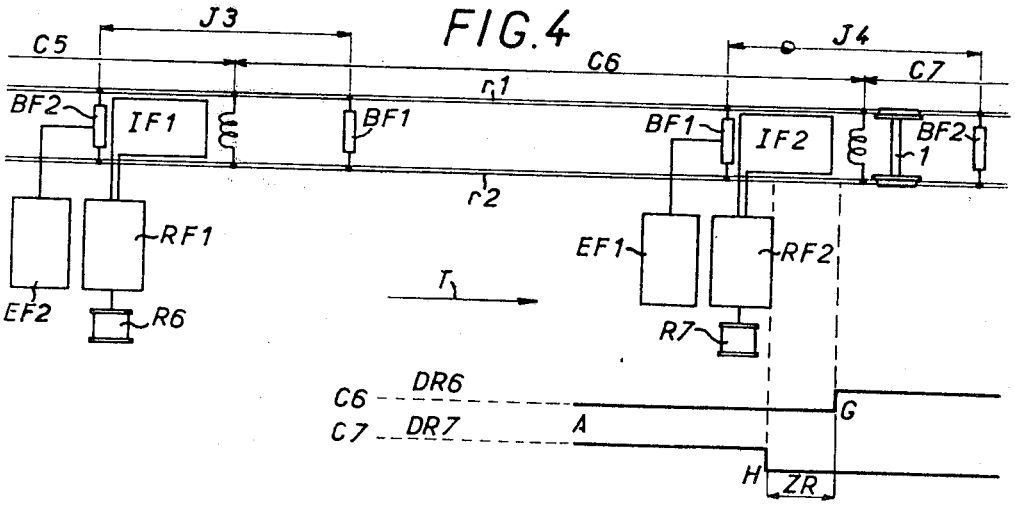
FIG. 4 is a schematic showing of a simplified alternative embodiment of the block separating joint of FIG. 2.

FIG. 4 relates to a modified embodiment of the track circuit of FIG. 2. The separating joints are each only equipped with a single inductive loop IF1 for separating joint J3 and IF2 for separating joint J4. Transmitter units EF1 and EF2 are coupled respectively to tuning units BF2 of separating joint J4 and tuning unit BF1 of separating joint J3.

As it is brought out by the operating diagrams of the relays R6 and R7 the overlapping shunting effect zone ZR between points G and H is still present but is reduced in length owing to the elimination of one of the induction loops in each of the separating joints.

Alternative embodiments of electrical block separating joints will now be described in which an independent block circuit is provided.

Figure 5:
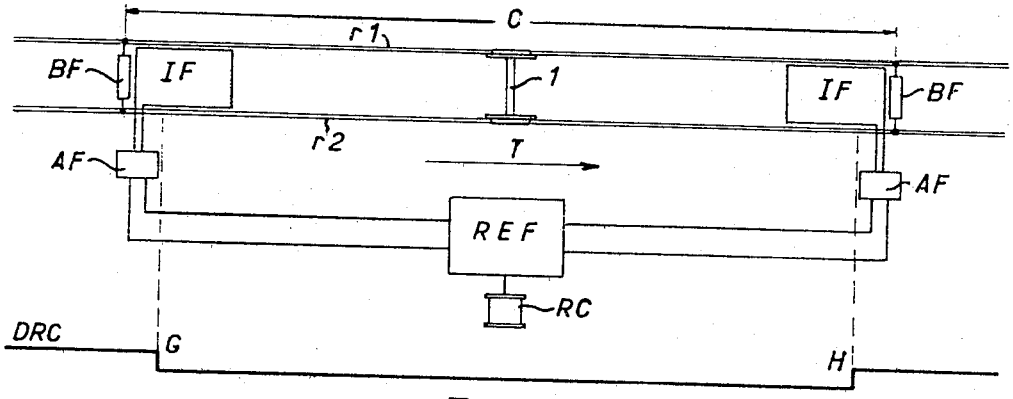
FIG. 5 is a schematic showing of an embodiment in which an independent block circuit is provided along the track.

Reference will first be made to FIG. 5 which corresponds to the general case of a block circuit C provided on a track having rails r1 and r2. The block circuit C is bounded at its ends by tuning units BF and comprises, between the tuning units and proximate thereto, inductive loops IF connected, through intermediate devices AF known per se to those skilled in the art, to a transceiver unit REF to which the control device RC associated with the block circuit C is connected.

The tuning units BF have identical characteristics and constitute very low impedances neighboring on a short-circuit impedances at the frequency F of the block circuit C.

Diagram DRC represents the changes of state or switching of the control device, e.g. a relay, RC when a representative axle 1 enters the block circuit bounded between the tuning units BF in the direction of the traffic flow T. Between points G and H (the location of which are only indicative and may vary as a function of the geometrical and electrical characteristics of the inductive loops), the relay RC remains de-energized. The de-energization information downstream of point G and the re-energization information upstream of point H may be utilized in the signaling system.

As pointed out above, the length of the block circuit C (the distance between the tuning units BF) permits the picking up of localized information at greater or lesser intervals. For instance, if the inter-tuning unit distance is held sufficiently constant, relay RC is able to sense each axle of a train, thereby operating as an axle counter.

Figure 6:
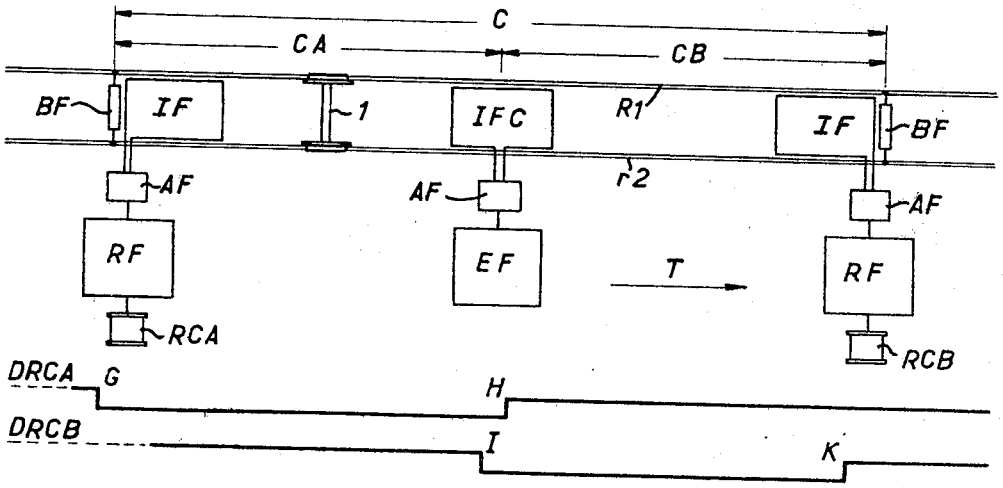
FIG. 6 is a schematic showing of a modification of the FIG. 5 embodiment.

Still, it is possible, with a view to obtaining different or more complex information, to divide up the data obtained from block circuit C by putting into operation a block circuit corresponding to the alternative embodiment of FIG. 6.

Bounded as before by the tuning units BF such as described above, the block circuit C in FIG. 6 does not comprise a transceiver unit but instead a transmitter EF coupled to a third central inductive loop IFC. Signals carried by the same are picked up by two receiver units RF coupled to inductive loops IF at the ends of the block circuit, each receiver unit RF then being coupled to a relay RCA or RCB.

Such an arrangement thus permits, as illustrated by the operational diagram of relays RCA and RCB, gathering of data subsequent to the axle entering sub-block circuits CA and CB.

Zones GH and IK of diagrams DRCA and DRCB correspond to the de-energization periods of the respective relays RCA and RCB.

As mentioned above with regard to the block circuit of FIG. 5 the block circuit may be of variable length, e.g. relatively short.

Furthermore, it is well known to those skilled in the art that a conventional electrical separating joint separating two adjacent block circuits in a railway signaling system is generally bounded at its ends by tuning units BF1 and BF2 tuned to the frequencies F1 and F2 of adjacent block circuits. Under these conditions, tuning units BF of the block circuit C in FIG. 5 may be identical with the tuning units BF1 and BF2 provided that the tuning units comply with the following dual criteria: its impedance is sufficient with respect to the frequencies of neighboring block circuits; and its impedance is very low at the single frequency of the block circuit C.

Figure 7:
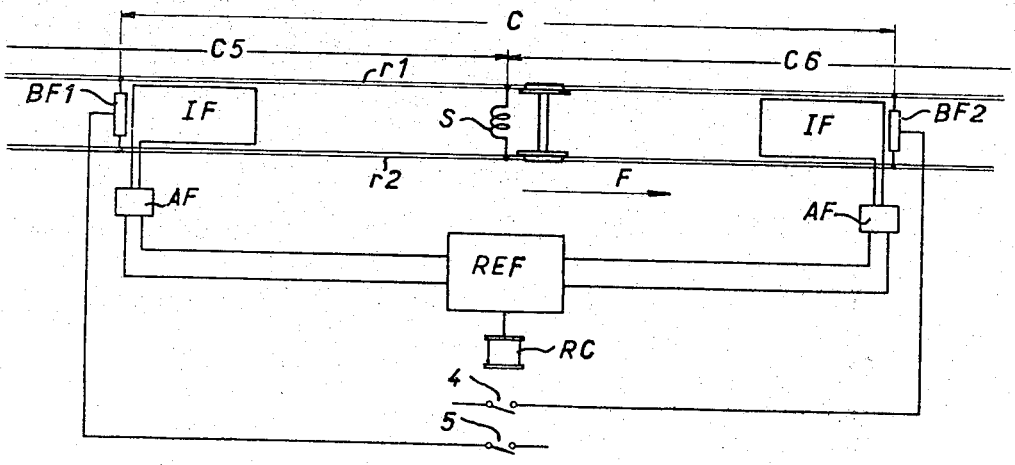
FIG. 7 is a schematic showing of an overlay block circuit of an independent block circuit on a conventional block separating joint.

Assuming these criteria are fulfilled, it is possible to overlay a block track circuit C according to FIG. 5 on a conventional separating joint. FIG. 7 illustrates a conventional separating joint in which the signaling program is not adapted to permit the integration of an inductive loop according to any of the embodiments of FIGS. 1–4.

Circuit C then serves as a separating joint with inductive loops between adjacent block circuits C5 and C6 operating on frequencies F1 and F2 respectively. Therefore block circuits C5 and C6 overlie each other which may then be referred to as the main or carrier circuits of a block circuit C responsive to a single frequency F.

It will be noted that in such a case the transmitter or receiver units of adjacent block circuits C1 and C2 may be operatively controlled by relay RC of the overlay block circuit C by means of one or more switches 4, 5 of the relay RC. The inductance coil S represented in FIG. 7 has an air core and this arrangement is conventional in electrical separating joints of the prior art.

It is readily apparent that the block circuit C of FIG. 7 may be "overlaid" at any location on the main or carrier block circuit C1 or C2. Moreover, considering FIG. 6, it should be emphasized that the central inductive loop IFC may take any position between the end inductive loops IF.

Figure 8:
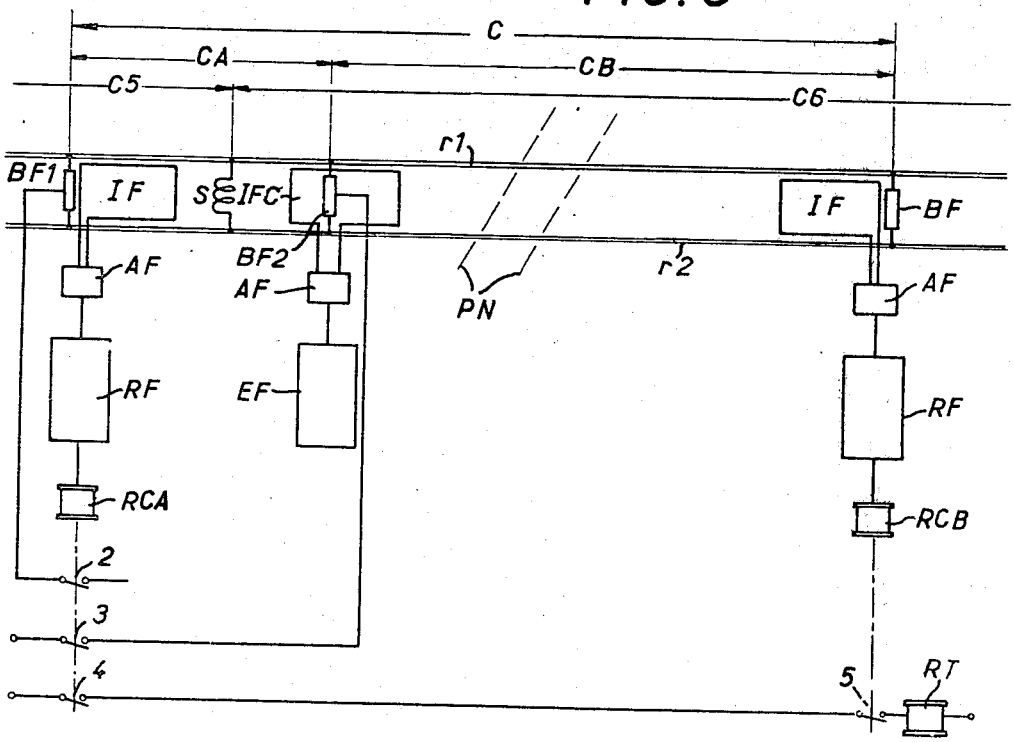
FIG. 8 is a schematic showing of a generalized embodiment of the block circuits of FIGS. 6 and 7.

FIG. 8 illustrates an alternative embodiment combining the foregoing two arrangements. The block circuit C with three inductive loops according to FIG. 6 overlies the separating joint of FIG. 7 so that the central inductive loop IFC overlaps the tuning unit BF2. The central inductive loop has upstream and downstream lines cooperating with the inductive loop IF upstream of block circuit CA and with inductive loop IF downstream of the overlay block circuit CB. The inclined dashed lines PN indicate a grade or level crossing. It will be recalled that the tuning units BF1 and BF2 are conventionally coupled to the transmitter or receiver units at one of the frequencies F1 and F2 of the block circuits C1 and C2. The transmitter and receiver units are represented by their switches 2 and 3 operatively controlled by relay RCA of the block circuit CA. Switches 4 and 5 mounted in series with a relay RT are respectively controlled by relays RCA and RCB.

The signaling system is shown with a vacant track, i.e., free of rolling stock. In these conditions the block circuit C with three inductive loops insures the following two functions: formation of an overlapping shunting effect zone in the block circuit CA as described in the embodiments of FIGS. 1–4 by means of the part associated with the loop IFC and the upstream loop IF; and integration by the relay RT acting as a totalizer of the partial data provided by the relays RCA and RCB located to each side of the level or grade crossing.

Portion CB of the block circuit C may, of course, be of any length adapted to the particularities of the level or grade crossing PN.

Figure 9:
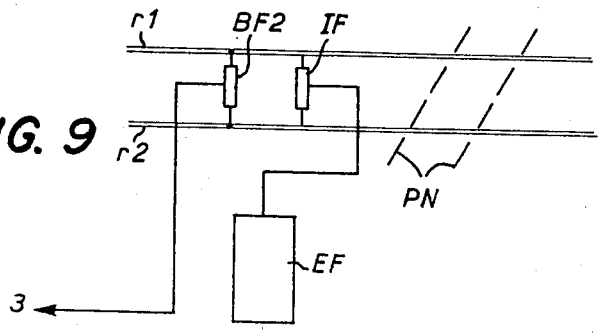
FIG. 9 is a fragmentary schematic showing of a modified block circuit of FIG. 8

For reasons inherent in railway signaling, it has been found advantageous in certain cases to replace in an arrangement similar to that FIG. 8, the central inductive loop by an impedance. This variant is represented in FIG. 9 as a part of FIG. 8. It will be noticed that the central inductive loop IFC is replaced by an impedance IF connected in parallel across the rails r1 and r2 proximate to the tuning unit BF2 and directly associated with the transmitter unit EF.

The possibilities offered by the invention will be appreciated. By permutating in a suitable manner the geometrical and electrical characteristics of the inductive loops it is possible to obtain operating diagrams of the relays associated with the block circuits producing particular overlapping shunting effect zones or specialized data.

Figure 10:
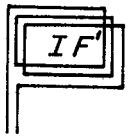
FIG. 10 is a diagrammatic detailed showing of an alternative inductive loop.

In particular in the foregoing embodiments the inductive loops IF, IF1 and IF2 have been illustrated as comprising a single winding. It is also possible to provide a plurality of serially connected windings as illustrated diagrammatically in FIG. 10.

It goes without saying that the invention is not intended to be limited to the illustrated and described embodiments but on the contrary includes all modifications, alternatives and expedients within the scope of the appended claims.

What is claimed is:

1. In a railway block signaling system in which rails of the railway track serve as electrical conductors, an electrical joint for separating two adjacent block circuits respectively upstream and downstream relative to the direction of traffic flow, the upstream block circuit being adapted to carry electric signals of a first frequency and said downstream block circuit being adapted to carry electric signals of a second frequency, said electrical block separating joint being bounded at its respective ends by upstream impedance means selected as a function of the first frequency and constituting a low value at the second frequency and a capacitive value at the first frequency, and downstream impedance means selected as a function of the second frequency and constituting a low value at the first frequency and a capacitive value at the second frequency, a receiver unit and a transmitter unit, said upstream impedance means being associated with a selected one of the receiver unit and the transmitter unit, and said downstream impedance means being associated with the nonselected one of the receiver unit and the transmitter unit, said receiver unit being normally adapted to activate a control device for its associated block circuit and de-activate the control device in response to the shunting effect caused by a vehicle axle present in the associated block circuit, and an inductive loop coupled to one said receiver or transmitter unit and constructed and arranged so that upon presence of a vehicle axle the gradual return of the amplitude of the first frequency signal to the amplitude of activation of the control device for the upstream circuit block occurs after the gradual attenuation of the second frequency signals in the downstream block circuit to the amplitude causing the de-activation of the control device thereby providing an overlapping shunting effect zone.

2. An electrical joint according to claim 1, wherein each said impedance means comprises a tuning unit.

3. An electrical joint according to claim 1 or 2, wherein said inductive loop is coupled the rails of a said block circuit.

4. An electrical joint according to claim 1 or 2, wherein said inductive loop is of rectangular configuration with two sides parallel to the rails of the track.

5. An electrical joint according to claim 4, wherein said inductive loop comprises a single winding.

6. An electrical joint according to claim 4, wherein said inductive loop comprises a plurality of serially connected windings.

7. An electrical joint according to claim 2 said inductive loop being a first inductive loop and there being a second inductive loop, and said first and second inductive loops are provided respectively located at the upstream and downstream ends of said electrical joint.

8. An electrical joint according to claim 7, wherein at least one of said inductive loops is coupled to said receiver or transmitter unit responsive to the frequency of the block circuit with which it is associated.

9. An electrical joint according to claim 7, wherein a first or upstream said inductive loop relative to the direction of traffic flow is coupled to a said receiver or transmitter unit for first frequency signals, and wherein a second or downstream said inductive loop is coupled to a said receiver or transmitter unit for the second frequency.

10. An electrical joint according to claim 7, wherein the first and second inductive loops are coupled to a said receiver or transmitter unit which is responsive to a single frequency and wherein at least one of said tuning units bounding said electrical joint at its ends has a low impedance at the single frequency.

11. An electrical joint according to claim 10, further comprising a third inductive loop disposed between said first and second inductive loops subdividing said block circuit associated therewith into upstream and downstream sub-blocks, said third inductive loop being coupled to said transmitter unit which is responsive to the single frequency and wherein said first and second inductive loops are each coupled to a said receiver unit which is responsive to the single frequency and adapted to activate a said control device.

12. An electrical joint according to claim 11, wherein said third inductive loop comprises an impedance connected in parallel across the rails and coupled to said single frequency transmitter unit.

13. A block circuit according to claim 11, wherein said separating joint overlies a said block circuit responsive to different electric signals.

14. An electrical joint according to claim 11, wherein one of said inductive loops controls means outside said signaling system.

15. An electrical joint according to claim 7, wherein said first or upstream inductive loop is coupled to said receiver unit and said second or downstream inductive loop is coupled to said transmitter unit.

16. An electrical joint according to claim 7, wherein one of said inductive loops controls means outside said signaling system.

17. An electrical joint according to claim 1, wherein said inductive loop is coupled to a said receiver unit responsive to a single frequency, said impedance means at one end of said electrical joint being a tuning unit adjacent said inductive loop and offering a low impedance at the single frequency and said impedance means at the other end being wired in parallel across the rails and coupled to said transmitter unit which is responsive to a single frequency, thereby providing an independent block circuit.

18. A block circuit according to claim 17, wherein said separating joint overlies a said block circuit responsive to different electric signals.

19. An electrical joint according to claim 1, wherein said electrical joint comprises a control device adapted to be activated by said receiver unit.

20. In a railway block signaling system in which rails of the railway track serve as electrical conductors, an electrical joint for separating two adjacent block circuits respectively upstream and downstream relative to the direction of traffic flow, the upstream block circuit being adapted to carry electric signals of a first frequency and said downstream block circuit being adapted to carry electric signals of a second frequency, said electrical block separating joint being bounded at its respective ends by upstream impedance means selected as a function of the first frequency and constituting a low value at the second frequency and a capacitive value at the first frequency, and a downstream impedance means selected as a function of the second frequency and constituting a low value at the first frequency and a capacitive value at the second frequency, a receiver unit and a transmitter unit, said upstream impedance means being associated with a selected one of the receiver unit and the transmitter unit, and said downstream impedance means being associated with the nonselected one of the receiver unit and the transmitter unit, said receiver unit being normally adapted to activate a control device for its associated block circuit and de-activate the control device in response to the shunting effect caused by a vehicle axle present in the associated block circuit, and a first or upstream inductive loop coupled to said receiver unit and a second or downstream inductive loop coupled to said transmitter unit, said inductive loops being constructed and arranged so that upon presence of a vehicle axle the gradual return of the amplitude of the first frequency signal to the amplitude of activation of the control device for the upstream circuit block occurs after the gradual attenuation of the second frequency signals in the downstream block circuit to the amplitude causing the de-activation of the control device thereby providing an overlapping shunting effect zone.

* * * * *